United States Patent [19]

Haynes

[11] Patent Number: 4,896,407

[45] Date of Patent: Jan. 30, 1990

[54] AIR PRESSURE CONTROL FOR YARN TEXTURING PROCESSES

[75] Inventor: Olin D. Haynes, Inman, S.C.

[73] Assignee: Milliken Research Corporation, Spartanburg, S.C.

[21] Appl. No.: 318,252

[22] Filed: Mar. 3, 1989

[51] Int. Cl.[4] ..... D02G 1/00; D02J 1/00

[52] U.S. Cl. ..... 28/248; 28/258; 28/271

[58] Field of Search ..... 28/248, 258, 27 H

[56] References Cited

U.S. PATENT DOCUMENTS

| | | | |
|---|---|---|---|
| 4,014,085 | 3/1977 | Fink et al. | 28/248 |
| 4,368,612 | 1/1983 | Eschenbach | 28/258 |
| 4,674,273 | 6/1987 | Clements et al. | 28/258 |

*Primary Examiner*—Werner H. Schroeder
*Assistant Examiner*—Jodi A. Takar
*Attorney, Agent, or Firm*—Earle R. Marden; H. William Petry

[57] ABSTRACT

A yarn texturing system employing an air jet yarn treating device which is supplied air under pressure which is automatically controlled upon start-up and shut-down of the yarn texturing system.

4 Claims, 1 Drawing Sheet

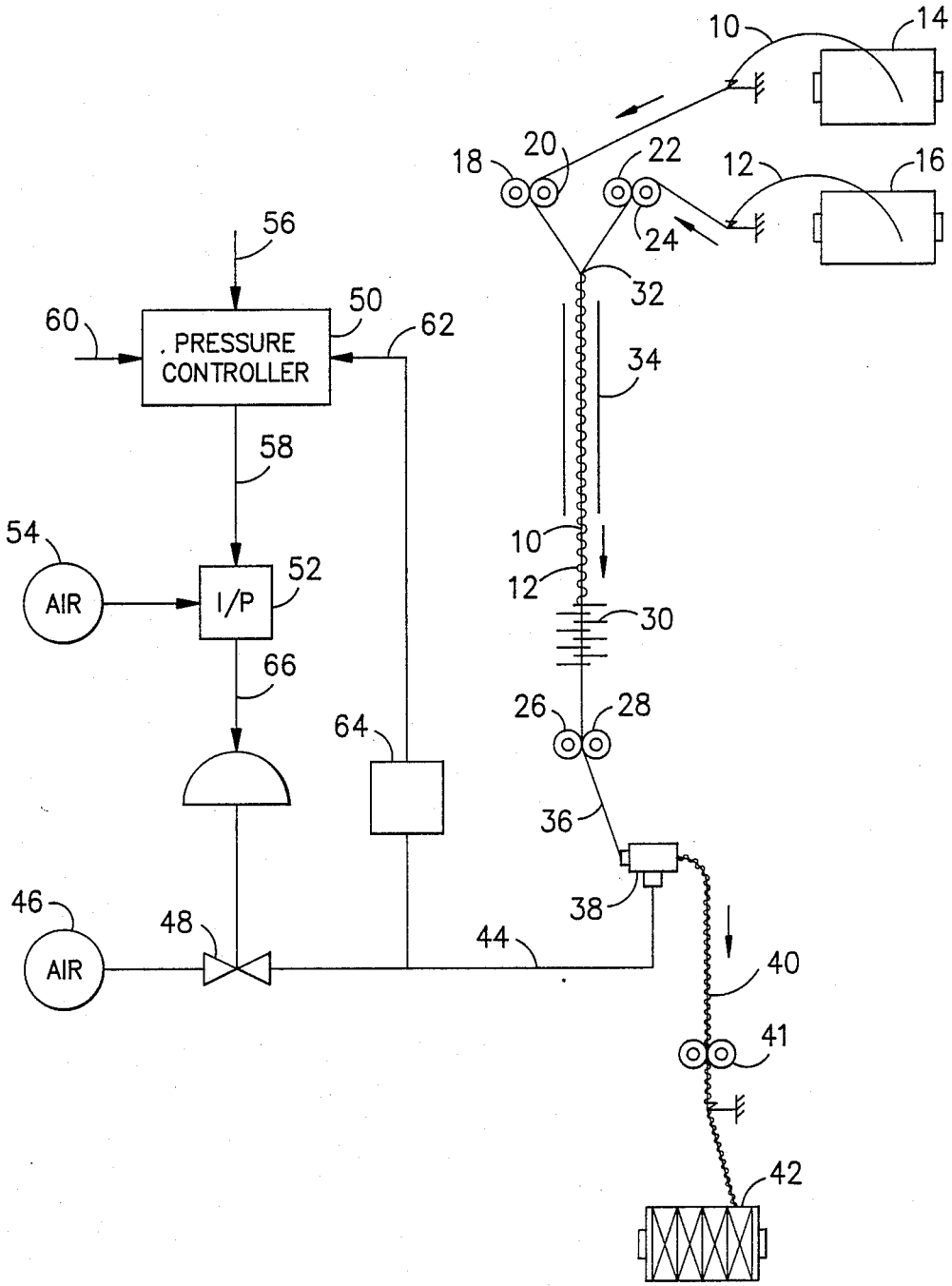
10
14
18
20
22
12
16
24
56
32
60
50
62
. PRESSURE CONTROLLER
34
58
54
10
52
AIR
I/P
12
30
66
26
28
64
36
38
46
48
44
40
AIR
41
42

AIR PRESSURE CONTROL FOR YARN TEXTURING PROCESSES

This invention relates generally to the treatment of continuous filament, synthetic yarn to produce a spun-like yarn. In particular, the invention is directed to a combination of a plurality of continuous filament, synthetic yarns which are drawn, false twisted and air textured to produce a spun-like composite yarn having a nonuniform appearance wherein the pressure of the air being supplied to the air texturing jet is automatically controlled.

It is therefore an object of the invention to provide a method to produce a nonuniform spun-like yarn from a plurality of continuous filament, synthetic, partially oriented yarns in which the air pressure to the air jet acting on the continuous filament yarn or yarns is automatically controlled.

Other objects of the invention will become readily apparent as the specification proceeds to describe the invention with reference to the accompanying drawing which represents schematically the new and novel process to produce a spun-like yarn.

Looking now to the drawing, a pair of yarns 10 and 12 are supplied, respectively, from yarn packages 14 and 16 to the feed rolls 18 and 20 and 22 and 24. The yarn 10 is preferably a DuPont 200 Denier/68 filament 242 T polyester yarn which is supplied to the driven rolls 18 and 20 to deliver yarn 10 at a rate of 200 meters/minute. The yarn 12 is preferably a DuPont 170 Denier/100 filament 56 T polyester yarn which is delivered at a rate of 185 meters/minute by the rolls 22 and 24.

Between the rolls 18, 20, 22, 24 and the rolls 26 and 28, the yarns 10 and 12 are plied, crimped and drawn. The rolls 26 and 28 are driven at a rate to supply yarn at 264 meters/minute. Upon starting of the device, the yarns 10 and 12 are brought together at the crimping apparatus 30, schematically represented as friction discs, and when the crimping apparatus is started up, it twists one yarn around the other until the twist equilibrium or ply point 32 is reached just above the heater 34.

While the yarns 10 and 12 are being crimped, they are also being drawn between the rolls 18, 20, 22, 24 and the rolls 26, 28. The primary heater 34 is operating at a temperature of approximately 220° C to heat the yarns 10 and 12 as they pass therethrough. The yarns 10 and 12 are partially oriented and therefore have a nominal denier (the fully oriented denier) to which it can be drawn to. The nominal denier for the yarn 10 is 150 and for the yarn 12 is 100. Then, the nominal draw ratio for yarn 10 is 200/150 or 1.333 and for the yarn 12 is 170/100 or 1.70. It can be seen that the actual draw ratio for the yarn 10 is 264/200 or 1.32 and for the yarn 12 is 264/185 or 1.43. The composite yarn 36 is therefore comprised of a yarn 10 which is substantially fully oriented and a yarn 12 which is partially oriented. In the preferred form of the invention, the draw ratio of the yarn 12 is 73% of the nominal.

The draw ratios above described are independently adjustable and are adjusted to provide different levels of tension in the yarns 10 and 12. This causes the yarn with the higher tension to remain relatively straight while the second yarn (looser tension) wraps around the first yarn. The wrapping yarn therefore is drawn more causing it to be longer than the core yarns when they are untwisted by the crimping apparatus 30 (false twister). Therefore, the yarn 12 is wrapped around the yarn 10.

The composite yarn 36 from the crimping apparatus 30 is overfed to the air jet 38 so that the filaments of the yarn 36 are commingled to lock in the loops formed by the yarn 12 in the air jet 38 to provide the spun-like yarn 40 which is taken upon the package 42. It has been found that the best loop formation in the air jet 38 is achieved when the pressure of air supplied to the jet is approximately 100 p.s.i. The yarn 40 from the jet 38 is delivered by the rolls 41 at a speed of 248 meters/minute where it is taken up at a speed of 254 meters/minute. It should be noted that the composite yarn 36 is not heated to heatset same after being forwarded by the draw rolls 26, 28.

To enhance the production of the yarn 40 and the prevent irregularities therein the pressure of the compressed air being supplied to the jet 38 on startup and stopping should be carefully controlled. To accomplish this control the control system shown in the drawing is used to control the air pressure in the conduit 44 from the compressed air supply 46 to the air jet 38.

To control the pressure in the conduit 44 a valve 48 is used which is controlled by a signal from the pressure controller 50 through a current to pressure converter 52, commonly called an I to P converter, which receives control pressure air from a source 54. The pressure controller is given a set pressure/speed ratio setting, represented by 56, and automatically produces an output signal 58 to the converter 52 based upon the measured machine speed signal 60, the signal 62 from the pressure transmitter 64 and the predetermined set pressure/speed ratio 56. The pressure transmitter 64 is measuring actual pressure in the conduit 44, as delivered through the valve 48 the opening or closing of which is controlled by the signal 66 from the converter 52. Basically the control circuit is designed to incrementally bring the air jet 44 pressure up to the desired level on start-up of the texturing machine and to incrementally reduce the air pressure to the jet 44 as the machine slows to a stop. This control is applicable to any texturing system whether the air jet is texturing the yarn or commingling the yarn since the purpose of the control is the same in both operations of the jet.

It can be seen that a yarn texturing system employing an air jet has been described which employs a control system to protect the yarn being produced by adjusting the air pressure being supplied to the air jet upon start-up and shut-down. This control system enhances yarn uniformity and tends to reduce the number of defects injected into the yarn being produced.

Although the preferred embodiment of the invention has been described it is contemplated that changes may be made without departing from the scope or spirit of the invention and it is desired that the invention be limited only by the scope of the claims.

I claim:

1. Method to produce a textured yarn comprising the steps of: supplying a continuous filament synthetic yarn to an air jet being supplied air under pressure, texturing the yarn in the air jet, taking up the textured yarn and controlling the air pressure being supplied to the air jet upon start-up and shut-down in response to the pressure of the air being supplied to the air jet and the speed of the texturing machine.

2. The method of claim 1 wherein the air pressure is reduced when the texturing machine is shut down.

3. The method of claim 2 wherein the air pressure is reduced by using a pressure controller which matches the actual machine speed with the actual air pressure being supplied to the air jet to a predetermined set pressure-speed relationship.

4. Apparatus to texture continuous filament synthetic yarn comprising: a yarn texturing system using an air jet, conduit means supplying air under pressure to said air jet, a first means operably associated with said conduit means measuring pressure of the air in said conduit means, automatically controlled valve means upstream of said first means to control the pressure of air in said conduit means and a pressure controller means operably connected to said valve means receiving a signal from said first means and the actual speed of the yarn texturing machine to control the opening and closing of said valve means.

* * * * *